US006864842B2

(12) United States Patent
Hung et al.

(10) Patent No.: US 6,864,842 B2
(45) Date of Patent: Mar. 8, 2005

(54) TRI-BAND ANTENNA

(75) Inventors: Zhen-Da Hung, Tu-Chen (TW); Lung-Sheng Tai, Tu-Chen (TW); Kuang-Yuan Chang, Tu-Chen (TW); Chia-Ming Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/448,051

(22) Filed: May 28, 2003

(65) Prior Publication Data

US 2004/0196191 A1 Oct. 7, 2004

(30) Foreign Application Priority Data

Apr. 4, 2003 (TW) ..... 92205314 U

(51) Int. Cl.[7] ..... H01Q 1/38
(52) U.S. Cl. ..... 343/700 MS; 343/702
(58) Field of Search ..... 343/700 MS, 702, 343/846, 848

(56) References Cited

U.S. PATENT DOCUMENTS

| | | | | |
|---|---|---|---|---|
| 5,075,691 | A | 12/1991 | Garay et al. | 343/830 |
| 5,867,131 | A | 2/1999 | Camp, Jr. et al. | 343/797 |
| 2004/0017315 | A1 * | 1/2004 | Fang et al. | 343/700 MS |
| 2004/0017319 | A1 * | 1/2004 | Wang et al. | 343/702 |

* cited by examiner

*Primary Examiner*—Hoang V. Nguyen
(74) *Attorney, Agent, or Firm*—Wei Te Chung

(57) ABSTRACT

A tri-band antenna (1) includes an insulative planar base (10), a low-frequency radiating portion (20), a high-frequency radiating portion (30), a first ground portion (40) and a signal feeder cable (70). A resonating lacuna (60) is defined between the first radiating portion (20) and the first ground portion (40). The signal feeder cable (70) includes an inner core wire (71) and a metal braiding layer (72) respectively soldered onto the connecting point of the low-frequency radiating portion (20) and the high-frequency radiating portion (30) and the first ground portion (40).

18 Claims, 9 Drawing Sheets

TRI-BAND ANTENNA

BACKGROUND OF THE INVENTION

1. Field of the Invention

The present invention relates to an antenna, and in particular to a tri-band antenna embedded in a mobile electronic device.

2. Description of the Prior Art

In 1999, the wireless local area network (WLAN) market saw the introduction of the 2.4 GHz IEEE 802.11b standard. Today 802.11b and IEEE 802.11a are among several technologies competing for market leadership and dominance.

The wireless 802.11a standard for WLAN runs in the 5 GHz spectrum, from 5.15–5.825 GHz. 802.11a utilizes the 300 MHz of bandwidth in the 5 GHz Unlicensed National Information Infrastructure (U-NII) band. Although the lower 200 MHz is physically contiguous, the Federal Communications Commission (FCC) has divided the total 300 MHz into three distinct 100 MHz realms; low (5.15–5.25 GHz), middle (5.25–5.35 GHz) and high (5.725–5.825 GHz), each with a different legal maximum power output in the U.S.

802.11a/b dual-mode WLAN products are becoming more prevalent up in the market, so there is a growing need for dual-band antennas for use in such products to adapt them for dual-mode operation. A dual-band antenna is a good miniaturized built-in antenna for mobile electronic products. However, the bandwidth of the conventional dual-band antenna is not wide enough to cover the total bandwidth of 802.11a and 802.11b. Generally, because of this narrowband characteristic, the bandwidth of the dual-band antenna can only cover the band of 802.11b and one or two bands of 802.11a.

One solution to the above problem is to provide an antenna for use with low-band, mid-band and high-band signals. For example, U.S. Pat. No. 5,867,131 discloses an antenna comprising three independent dipole pairs for providing respectively three different frequency bands operation. However, each dipole pair is excited in a narrow bandwidth, so this antenna could not cover all frequency bands of 802.11a and 802.11b unless additional dipole pairs are applied, which would increases the complexity of this antenna and the difficulty of matching impedance.

Hence, an improved antenna is desired to overcome the above-mentioned shortcomings of the existing antennas.

BRIEF SUMMARY OF THE INVENTION

A primary object, therefore, of the present invention is to provide a tri-band antenna with wider bandwidth performance in higher frequency band.

A tri-band antenna in accordance with the present invention includes an insulative planar base, a first ground portion, a second ground portion, a low-frequency radiating portion, a high-frequency radiating portion, and a signal feeder cable. The first ground portion, the low-frequency radiating portion, and the high-frequency radiating portion are made of sheet metal and are arranged on an upper surface of the insulative planar base. The second ground portion is arranged on a lower surface of the insulative planar base opposite to the first ground portion. The signal feeder cable comprises an inner core wire and a metal braiding layer respectively soldered onto the high-frequency radiating portion and the first ground portion. The high-frequency radiating portion and the first ground portion are configured to define a resonating lacuna therebetween. The low-frequency radiating portion receives or transmits low-frequency signal, while the high-frequency radiating portion receives or transmits high-frequency signal.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
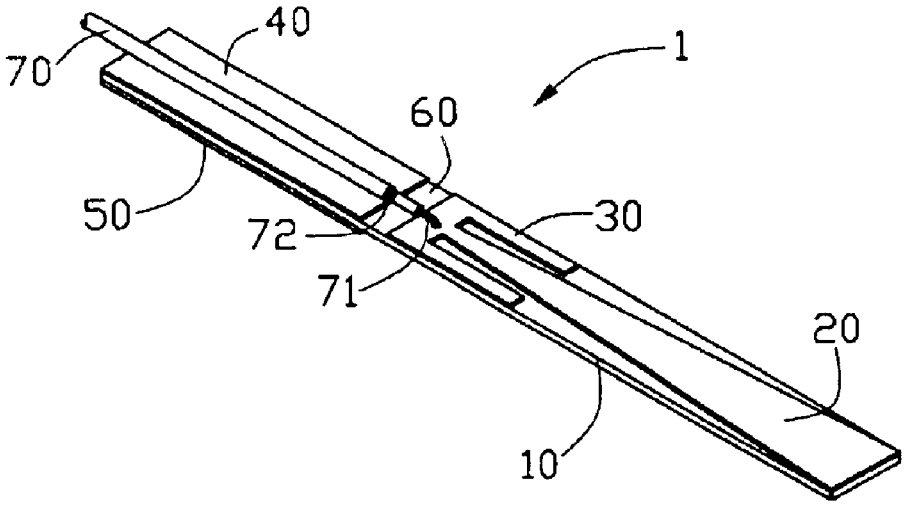
FIG. 1 is a perspective view of a preferred embodiment of a tri-band antenna in accordance with the present invention, with a coaxial cable electrically connected thereto.

Referring to FIG. 1, a tri-band antenna 1 in accordance with a preferred embodiment of the present invention comprises an insulative planar base 10, a low-frequency radiating portion 20, a high-frequency radiating portion 30, a first ground portion 40, a second ground portion 50 and a signal feeder cable 70.

The first ground portion 40, the low-frequency radiating portion 20, the high-frequency radiating portion 30 are made of conductive sheet metal, and are arranged on an upper surface of the insulative planar base 10. The second ground portion 50 also made of thin sheet metal is arranged on a lower surface of the insulative planar base 10 opposite to the first ground portion. The second ground portion 50 is electrically connected with the first ground portion by known manner in a printed circuit board (PCB). The low-frequency radiating portion 20 has a long and narrow triangular configuration and the high-frequency radiating portion 30 is U-shaped. A narrow end of the low-frequency radiating portion is electrically connected to a medial portion of the high-frequency radiating portion. Two arms of the high-frequency radiating portion 30 and the low-frequency radiating portion 20 extend in a common direction to configure approximately an "E" shape. The high-frequency radiating portion 30 and the first ground portion 40 are separated from each other to define a resonating lacuna 60 therebetween. The resonating lacuna 60 assists in increasing radiant energy and decreasing loss from the signal feeder cable 70.

The signal feeder cable 70 is a coaxial cable and comprises a conductive inner core wire 71 and a metal braiding layer 72. The inner core wire 72 is soldered onto the high-frequency radiating portion 30, and the metal braiding layer 72 is soldered onto the first ground portion 40.

Figure 2:
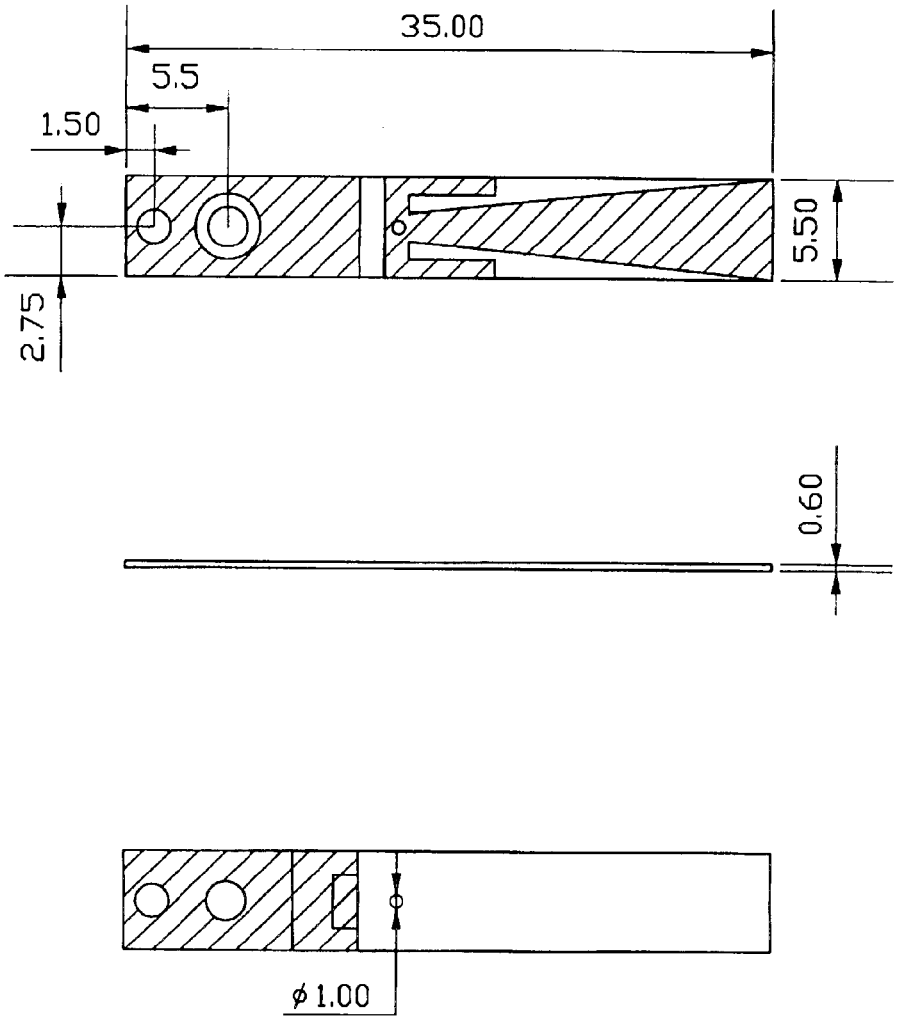
FIG. 2 illustrates major dimensions of the tri-band antenna of FIG. 1.

Referring to FIG. 2, major dimensions of the tri-band antenna 1 are labeled thereon, wherein all dimensions are in millimeters (mm).

Figure 3:
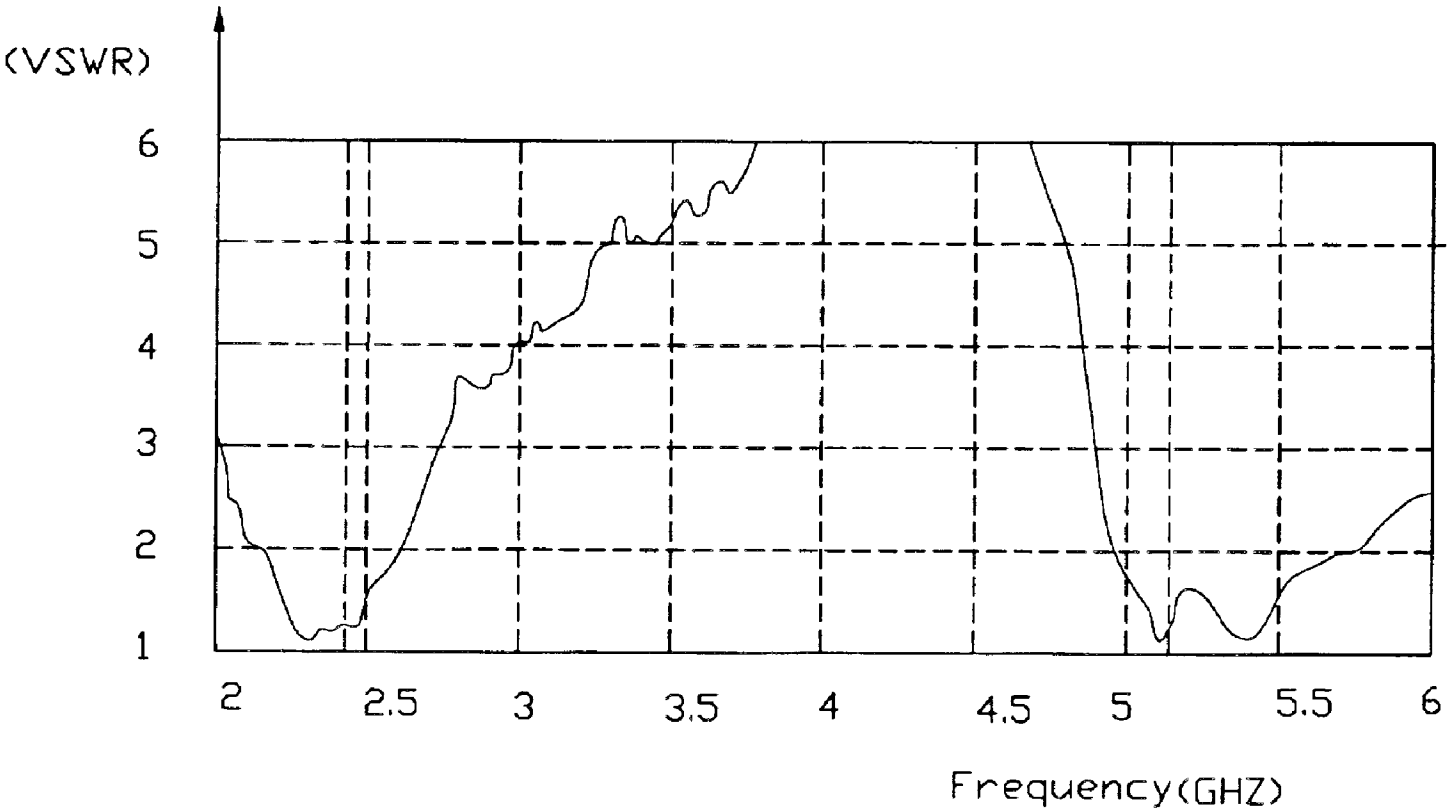
FIG. 3 is a test chart recording for the tri-band antenna of FIG. 1, showing Voltage Standing Wave Ratio (VSWR) as a function of frequency.
Figure 4:
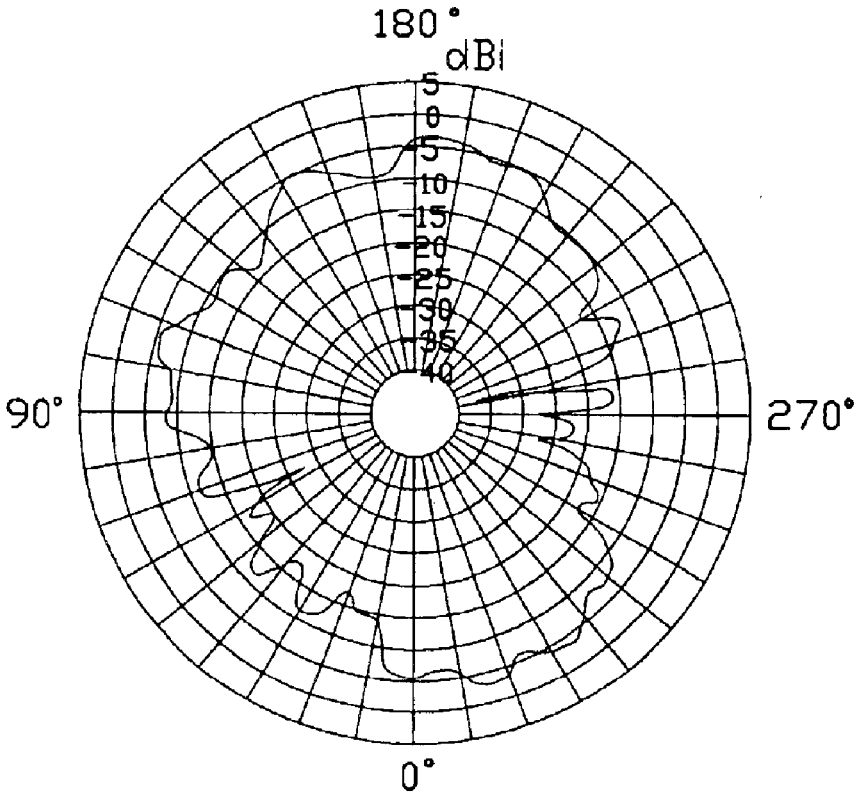
FIG. 4 is a recording of a horizontally polarized principle X-Y plane radiation pattern of the tri-band antenna of FIG. 1 operating at a frequency of 2.5 GHz.
Figure 5:
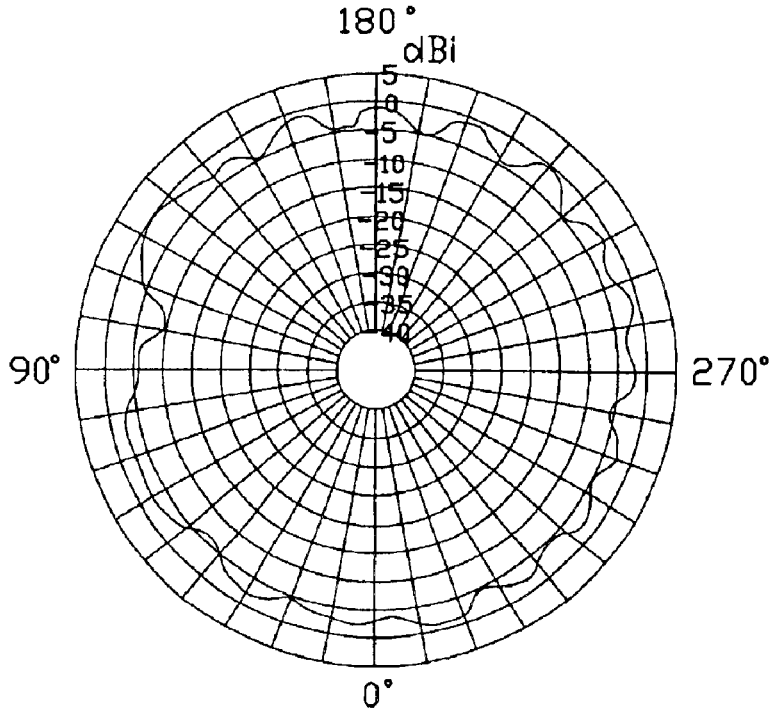
FIG. 5 is a recording of a vertically polarized principle X-Y plane radiation pattern of the tri-band antenna of FIG. 1 operating at a frequency of 2.5 GHz.
Figure 6:
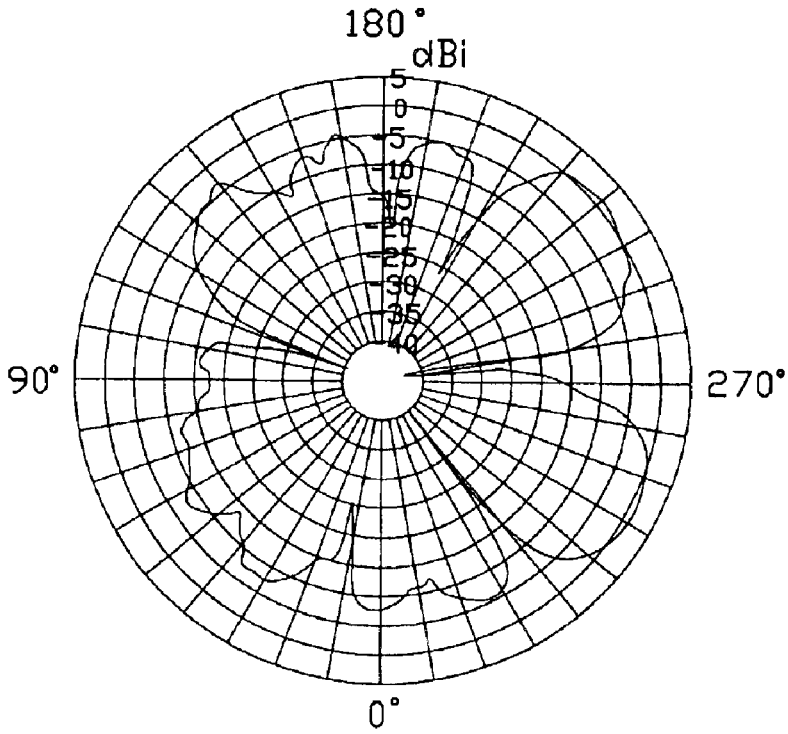
FIG. 6 is a recording of a horizontally polarized principle X-Y plane radiation pattern of the tri-band antenna of FIG. 1 operating at a frequency of 5.35 GHz.
Figure 7:
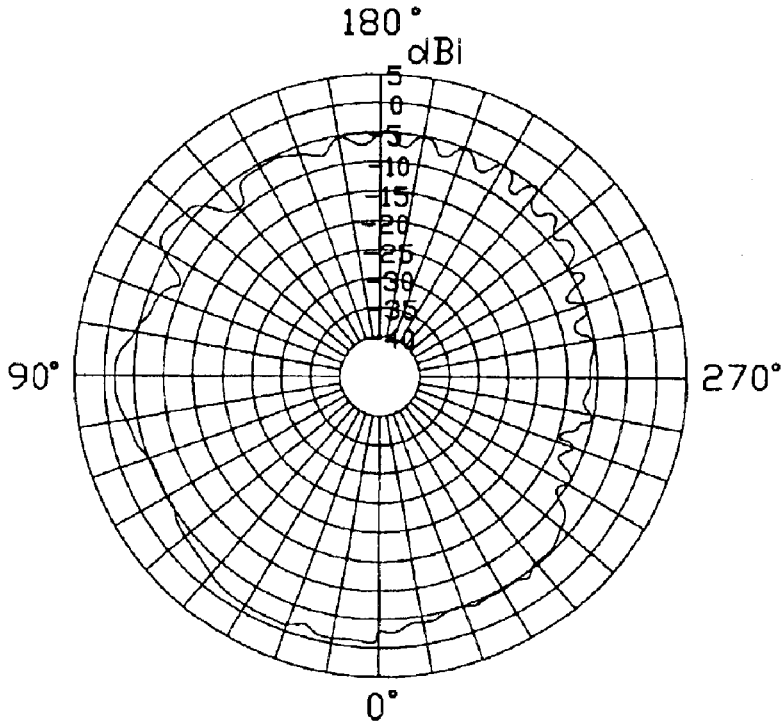
FIG. 7 is a recording of a vertically polarized principle X-Y plane radiation pattern of the tri-band antenna of FIG. 1 operating at a frequency of 5.35 GHz.
Figure 8:
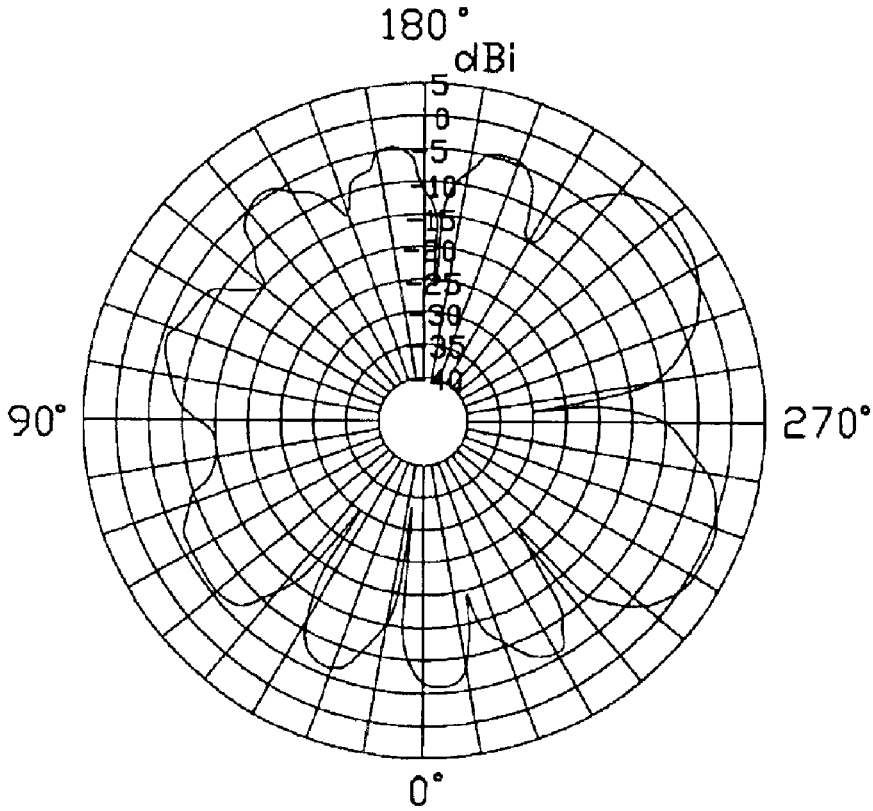
FIG. 8 is a recording of a horizontally polarized principle X-Y plane radiation pattern of the tri-band antenna of FIG. 1 operating at a frequency of 5.725 GHz.
Figure 9:
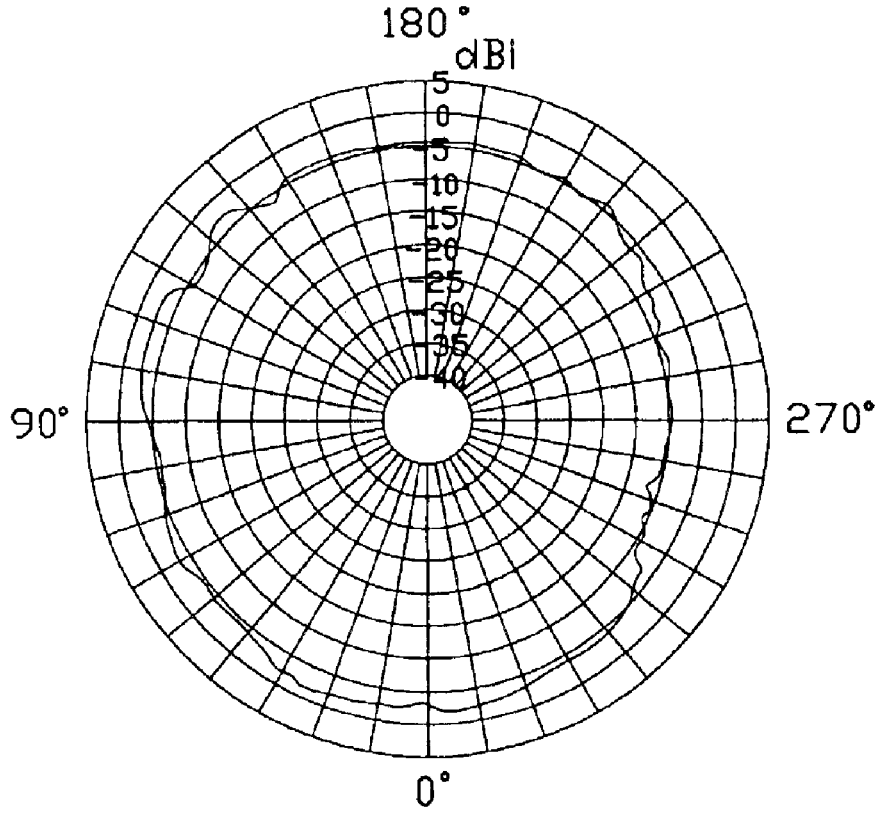
FIG. 9 is a recording of a vertically polarized principle X-Y plane radiation pattern of the tri-band antenna of FIG. 1 operating at a frequency of 5.725 GHz.

FIG. 3 shows a test chart recording of Voltage Standing Wave Ratio (VSWR) of the tri-band antenna 1 as a function of frequency. Note that VSWR drops below the desirable maximum value "2" in the 2.4–2.5 GHz frequency band and in the 5.15–5.725 GHz frequency band, indicating acceptably efficient operation in these two wide frequency bands, which cover more than the total bandwidth of the 802.11a and 802.11b standards.

FIGS. 4–9 respectively show horizontally and vertically polarized principle X-Y plane radiation patterns of the tri-band antenna 1 operating at frequencies of 2.5 GHz, 5.35 GHz, and 5.725 GHz. Note that each radiation pattern is close to a corresponding optimal radiation pattern and there is no obvious radiating blind area.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tri-band antenna for an electronic device, comprising:

an insulative planar base;

a first ground portion positioned on an upper surface of the insulative planar base;

a low-frequency radiating portion positioned on the upper surface of the insulative planar base and separated from the first ground portion, the low-frequency radiating portion and exciting at a lower frequency band;

a high-frequency radiating portion positioned on the upper surface of the insulative planar base and electrically connected to the low-frequency radiating portion, the high-frequency radiating portion exciting at a wider and higher frequency band; and a signal feeder cable comprising an inner core wire and a metal braiding layer respectively electrically connected to the high-frequency radiating portion and the first ground portion;

wherein a resonating lacuna is defined between the first ground portion and the high-frequency radiating portion.

2. The tri-band antenna as claimed in claim 1, wherein the low-frequency radiating portion has a long and narrow triangular configuration.

3. The tri-band antenna as claimed in claim 2, wherein the high-frequency radiating portion is U-shaped, and a narrow end of the low-frequency radiating portion is connected to a medial portion of the high-frequency radiating portion.

4. The tri-band antenna as claimed in claim 3, wherein two arms of the high-frequency radiating portion and the low-frequency radiating portion extend in a common direction to configure approximately like an "E" shape.

5. The tri-band antenna as claimed in claim 1, further comprising a second ground portion positioned on a lower surface of the insulative planar base opposite to the first ground portion and electrically connected to the first ground portion.

6. The tri-band antenna as claimed in claim 1, wherein the low-frequency radiating portion and the first ground portion are respectively formed of two individual metal plates.

7. The tri-band antenna as claimed in claim 1, wherein the low-frequency radiating portion and the high-frequency radiating portion are made of an integral first metal plate, the first ground portion being made of an integral second metal plate, the first and the second metal plates being unattached to one another.

8. A tri-band antenna, comprising:

a first ground portion;

a first monopole separated from the ground portion and exciting at a lower frequency band;

a pair of second monopoles respectively disposed on two sides of the first monopole and having a common connecting point with the first monopole for exciting at a higher frequency band;

an insulative base; and a signal feeder cable comprising an inner core wire and a metal braiding layer respectively electrically connected to the common connecting point and the first ground portion;

wherein the first ground portion, the first monopole, the second monopoles and the feeder cable are all positioned on an upper surface of the insulative base.

9. The tri-band antenna as claimed in claim 8, further comprising a second ground portion positioned on a lower surface of the insulative base opposite to the first ground portion and electrically connected to the first ground portion.

10. A tri-band antenna structure comprising:

a slender strap-like insulative planar base having opposite first and second faces;

a first and a second grounding conductive areas respectively located on the first and the second faces and electrically connected to each other of said base;

a radiating conductive area located on the first face of the base, and including a U-shaped high frequency radiating portion and a low frequency radiating portion which is located between two arms of said U-shaped high frequency radiating portion and extends away from the grounding conductive areas.

11. The antenna structure as claimed in claim 10, wherein said U-shaped high frequency radiating portion is essentially located on a middle portion of the base.

12. The antenna structure as claimed in claim 10, wherein the low-frequency radiating portion is of trapezoid-like configuration.

13. The antenna structure as claimed in claim 12, wherein the radiating conductive area is located on one side of the base in a lengthwise direction of said base, and the first and the second grounding conductive areas are located on an opposite side of the base along said lengthwise direction.

14. The antenna structure as claimed in claim 12, wherein a smaller end of said trapezoid-like configuration directly integrally extends from a horizontal middle portion of the U-shaped high frequency radiating portion.

15. The antenna structure as claimed in claim 10, wherein outer edges of two opposite arms of the U-shaped high frequency radiating portion reach opposite lengthwise edges of the base, respectively.

16. The antenna structure as claimed in claim 10, wherein the low-frequency radiating portion is of a trapezoid-like configuration, and a larger end of said trapezoid-like configuration reaches a longitudinal end of said base in a lengthwise direction thereof.

17. The antenna structure as claimed in claim 16, wherein said larger end occupies a full dimension of said longitudinal end and reaches opposite lengthwise edges of the base.

18. The antenna structure as claimed in claim 17, wherein outer edges of two opposite arms of the U-shaped high frequency radiating portion reach said opposite lengthwise edges of the base, respectively.

* * * * *